US010377980B2

(12) United States Patent
Souter et al.

(10) Patent No.: US 10,377,980 B2
(45) Date of Patent: Aug. 13, 2019

(54) PROCESS OF WASHING FABRICS

(71) Applicant: The Procter & Gamble Company, Cincinnati, OH (US)

(72) Inventors: Philip Frank Souter, Northumberland (GB); Robby Renilde Francois Keuleers, Lippelo (BE); Regine Labeque, Neder over Heembeek (BE); Florence Catherine Courchay, Brussels (BE); Marc Rene Bert Renmans, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 50 days.

(21) Appl. No.: 15/619,946

(22) Filed: Jun. 12, 2017

(65) Prior Publication Data

US 2017/0355936 A1 Dec. 14, 2017

Related U.S. Application Data

(60) Provisional application No. 62/349,216, filed on Jun. 13, 2016.

(51) Int. Cl.

| | |
|---|---|
| ***C11D 17/04*** | (2006.01) |
| ***A47L 15/44*** | (2006.01) |
| ***C11D 3/08*** | (2006.01) |
| ***D06F 39/02*** | (2006.01) |
| *C11D 3/37* | (2006.01) |
| *D06F 35/00* | (2006.01) |
| *D06F 37/30* | (2006.01) |
| *B65D 65/46* | (2006.01) |

(52) U.S. Cl.
CPC ..... *C11D 17/045* (2013.01); *A47L 15/4436* (2013.01); *C11D 3/08* (2013.01); *C11D 17/042* (2013.01); *D06F 39/024* (2013.01); *B65D 65/46* (2013.01); *D06F 35/006* (2013.01); *D06F 37/302* (2013.01)

(58) Field of Classification Search
CPC ..... C11D 17/042; C11D 17/045
USPC ..... 510/296, 297, 439
See application file for complete search history.

(56) References Cited

U.S. PATENT DOCUMENTS

| | | | | |
|---|---|---|---|---|
| 8,754,025 | B2 * | 6/2014 | Wiedemann | C11D 17/041 510/439 |
| 8,980,817 | B2 | 3/2015 | Wiedemann et al. | |
| 2016/0024446 | A1 * | 1/2016 | Lee | C11D 17/042 252/186.43 |
| 2016/0102278 | A1 * | 4/2016 | Labeque | C11D 17/042 510/296 |
| 2017/0355934 | A1 * | 12/2017 | Courchay | C11D 17/042 |
| 2017/0355935 | A1 * | 12/2017 | Courchay | C11D 17/042 |
| 2017/0355936 | A1 * | 12/2017 | Souter | A47L 15/4436 |
| 2017/0355937 | A1 * | 12/2017 | Courchay | C11D 1/04 |
| 2017/0369217 | A1 * | 12/2017 | Souter | B65D 65/46 |
| 2017/0369822 | A1 * | 12/2017 | Souter | B29C 66/7352 |

(Continued)

OTHER PUBLICATIONS

PCT International Search Report for application No. PCT/US2017/037113, dated Jun. 13, 2017, 15 pages.

*Primary Examiner* — Gregory E Webb
(74) *Attorney, Agent, or Firm* — Gregory S. Darley-Emerson; Melissa Krasovec

(57) ABSTRACT

The present invention relates to a process for washing fabrics in the drum of an automatic washing machine.

21 Claims, 3 Drawing Sheets

(56) References Cited

U.S. PATENT DOCUMENTS

2017/0369823 A1* 12/2017 Souter ..... C08K 5/0016
2018/0002647 A1* 1/2018 Souter ..... B29C 66/7352

* cited by examiner

PROCESS OF WASHING FABRICS

FIELD OF THE INVENTION

The present invention relates to a process for washing fabrics in the drum of an automatic washing machine.

BACKGROUND OF THE INVENTION

Consumers desire more environmentally friendly fabric wash processes. Often during the wash process there is a tendency to over or under dose the cleaning composition. Overdosing can result in waste of cleaning composition which is a waste of energy and resource in initially making the cleaning composition. Under-dosing can result in fabrics not meeting the consumer's desired level of cleanliness and so require a repeat of the wash operation which is again a waste of energy and resource.

Water-soluble unit dose articles provide a measured dosage of cleaning composition so avoiding the environmental impact of over or under dosing. However, under some wash conditions, e.g. low temperature, low water and/or short wash cycles or cycles where consumers have been overloading the machine, especially with items with high water absorption capacity, there is the possibility of the unit dose article not fully dissolving and leaving residues on fabrics. This then requires a repeat wash operation which again is a waste of energy and resource.

Therefore, there is a need for a more environmentally friendly fabric wash process.

It was surprisingly found that the process of the present invention provided a more environmentally friendly wash process.

SUMMARY OF THE INVENTION

The present invention is to a process for washing fabrics comprising the steps of;

a. Obtaining a water-soluble unit dose article comprising at least a first water-soluble film, a second water-soluble film and a detergent composition, wherein the first water-soluble film and the second water-soluble film are chemically different to one another, and wherein the first water-soluble film has a first water capacity, and wherein the second water-soluble film has a second water capacity, wherein the first water capacity is less than the second water capacity and wherein the difference between the water capacity of the first water soluble film and the second water-soluble film is between 0.01% and 1%;

b. Adding the water-soluble unit dose article an automatic washing machine, preferably the drum of an automatic washing machine, with fabrics to be washed, wherein preferably the fabrics comprise at least one stain or soil to be removed;

c. Washing the fabrics in an automatic washing machine wash process wherein said process comprises a main wash step.

BRIEF DESCRIPTION OF THE DRAWINGS

The figures herein are illustrative in nature and are not intended to be limiting.

DETAILED DESCRIPTION OF THE INVENTION

The Process

Figure 1:
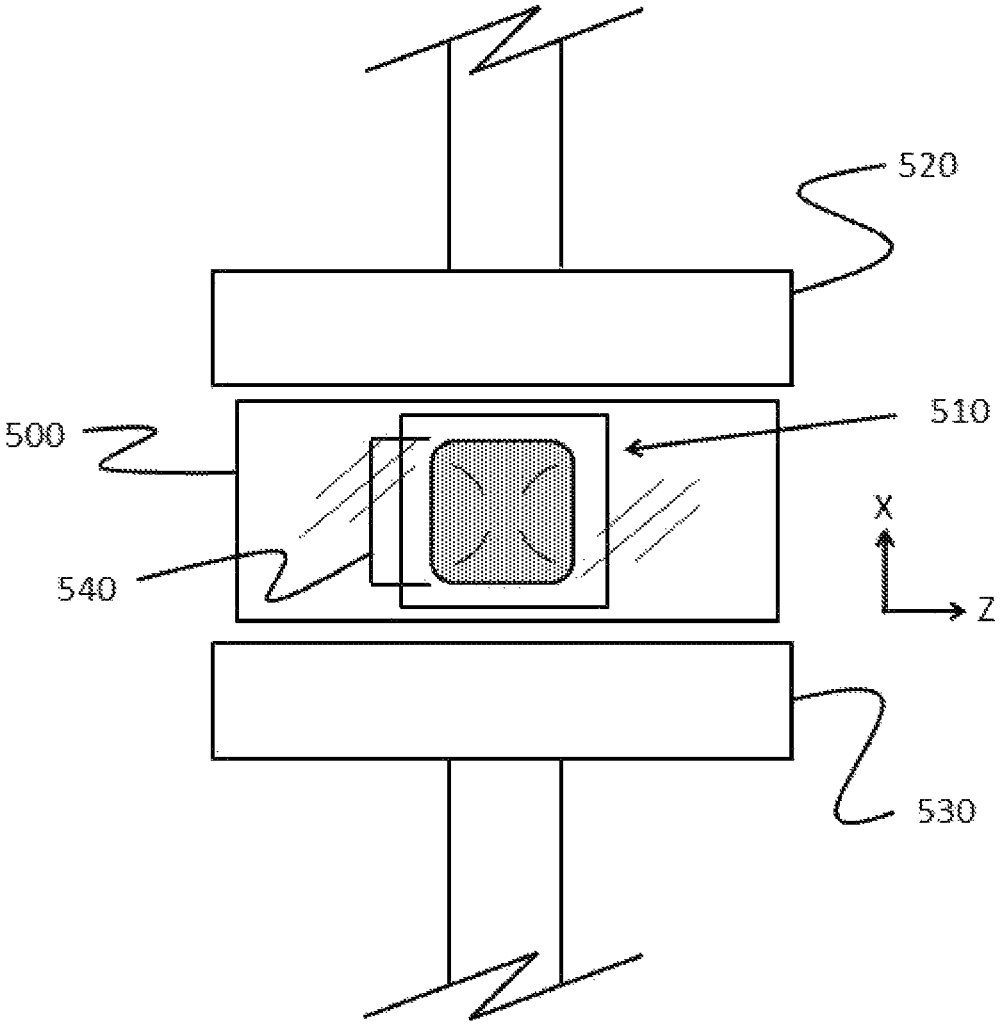
FIG. 1 shows a schematic illustration of the basic configuration of the unit dose article strength test and seal failure test.
Figure 2:
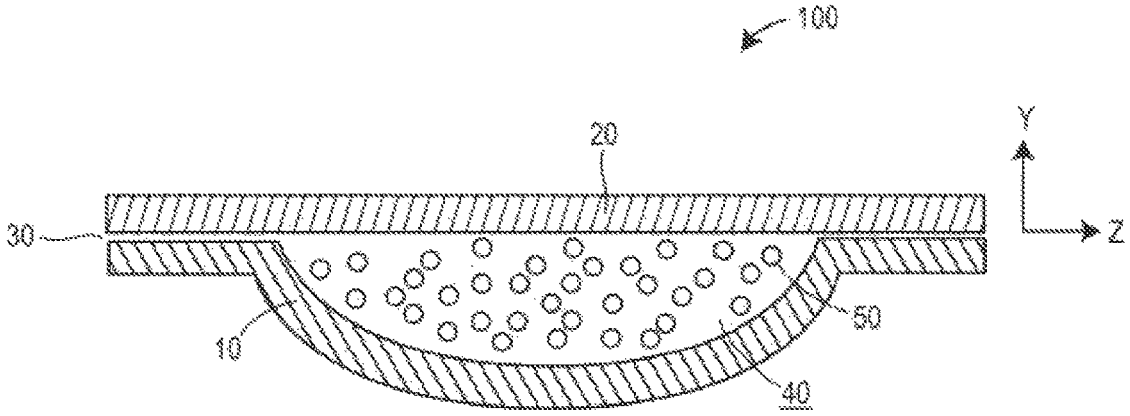
FIG. 2 shows a side cross-sectional view of a pouch.
Figure 3:
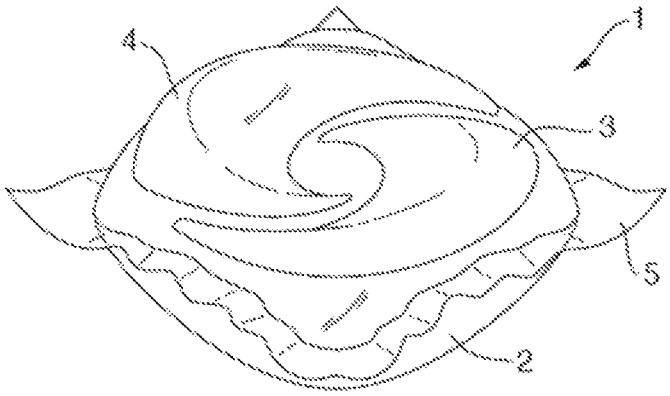
FIG. 3 shows a multi-compartment pouch.

The present invention is to a process for washing fabrics. The process comprises the step of;

a. Obtaining a water-soluble unit dose article comprising at least a first water-soluble film, a second water-soluble film and a detergent composition. The water-soluble unit dose article, the first water-soluble film, the second water-soluble film and the detergent composition are described in more detail below.

The process comprises the further step of;

b. Adding the water-soluble unit dose article to an automatic washing machine, preferably the drum of an automatic washing machine, with fabrics to be washed.

The water-soluble unit dose article is preferably added to the drum of a washing. Alternatively, the water-soluble unit dose article may be added to the drawer of an automatic washing machine.

The water-soluble unit dose article may be added to the washing machine by hand. The water-soluble unit dose article may be added to the drum by hand. Alternatively it may be dispensed from a storage receptacle into the washing machine, preferably the drum. Those skilled in the art will be aware of relevant storage receptacles.

Those skilled in the art will be aware of suitable automatic washing machines. Those skilled in the art will also be aware that automatic washing machines comprise a drum and a drawer and will be able to locate said drum or drawer and add both the fabrics and the water-soluble unit dose article thereto accordingly.

By fabric we preferably mean a textile or cloth comprising a network of natural or artificial fibers. Those skilled in the art will be aware of suitable fabrics. Preferably the fabrics are ones that are worn by consumers such as clothing. Preferably the fabrics comprise at least one stain or soil to be removed.

The process comprises a further step of;

c. Washing the fabrics in an automatic washing machine wash process wherein said process comprises a main wash step.

Those skilled in the art will be aware of standard washing machine processes. The skilled person will know how to select such a process on a standard washing machine. Without wishing to be bound by theory, washing machine processes comprise at least a main wash step. They may comprise other steps such as rinse steps, pre-wash steps or a mixture thereof.

The main wash may take between 5 minutes and 50 minutes, preferably between 5 minutes and 40 minutes, more preferably between 5 minutes and 30 minutes, even more preferably between 5 minutes and 20 minutes, most preferably between 6 minutes and 18 minutes.

The main wash step may comprise the addition of between 10 L and 60 L, preferably between 10 L and 40 L, more preferably between 10 L and 30 L, most preferably between 10 L and 20 L of water to the drum of the automatic washing machine.

The temperature of the water in the main wash step may be between 10° C. and 45° C., preferably between 15° C. and 35° C.

The automatic washing process may comprise at least one rinse step. The automatic washing machine process may comprise a final rinse step, preferably wherein the drum of the automatic washing machine rotates at a speed of between 500 rpm and 1700 rpm during the final rinse step.

Without wishing to be bound by theory, it is the specific steps in the present process that provide a more environmentally friendly fabric wash process. The first step of selecting a water-soluble unit dose article overcomes the issue of under- or over-dosing of the detergent composition. Also the step of specifically selecting a unit dose article having the film properties of the present invention in combination with the specific wash conditions of the subsequent steps in the process ensures excellent cleaning with minimal residues on fabrics thus minimizing requirements for rewashing which is wasteful of energy and resources. This is especially relevant for lower wash volumes, shorter main wash cycles and low wash temperatures which all contribute to provide a less energy and resource intensive wash process whilst still ensuring excellent fabric cleaning with minimal fabric residues and thus minimal requirement for rewashing.

Preferably the wash process is selected from short wash process, cold wash process or quick wash process. Those skilled in the art will know how to select a water-soluble unit dose article having the properties required by the present invention.

Preferably, between 4 kg and 15 kg, more preferably between 5 kg and 12 kg, most preferably between 6 kg and 8 kg of fabrics are added to the wash machine to be washed.

Water-Soluble Unit Dose Article

The process comprises a step (a) of obtaining a water-soluble unit dose article comprising at least a first water-soluble film, a second water-soluble film and a detergent composition.

The first water-soluble film and the second water-soluble film are chemically different to one another. The first water-soluble film has a first water capacity, and the second water-soluble film has a second water capacity and wherein the first water capacity is less than the second water capacity. The difference between the water capacity of the first water soluble film and the second water-soluble film is between 0.01% and 1%, preferably from 0.03% to 0.5%, most preferably from 0.05% to 0.3%. The first water-soluble film and the second water-soluble film are described in more detail below. By 'difference' we herein mean the difference in the value of the first water capacity and the value of the second water capacity. By 'water capacity' we herein mean the capacity of the film to absorb water over a fixed period of time at a particular relative humidity and temperature, measured as a mass increase of the film being tested. The method for measuring water capacity is described in more detail below.

The water-soluble unit dose article comprises the first water-soluble film and the second water-soluble film shaped such that the unit-dose article comprises at least one internal compartment surrounded by the water-soluble films. The water-soluble films are sealed to one another such to define the internal compartment and such that that the detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the detergent composition. During manufacture, the first water-soluble film according to the present invention may be shaped to comprise an open compartment into which the detergent composition is added. The second water-soluble film according to the present invention is then laid over the first film in such an orientation as to close the opening of the compartment. The first and second films are then sealed together along a seal region.

The unit dose article may comprise more than one compartment, even at least two compartments, or even at least three compartments. The compartments may be arranged in superposed orientation, i.e. one positioned on top of the other. In such an orientation the unit dose article will comprise three films, top, middle and bottom. Preferably, the middle film will correspond to the second water-soluble film according to the present invention and top and bottom films will correspond to the first water-soluble film according to the present invention. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment. In such a multicompartment orientation, the first water-soluble film according to the present invention may be shaped to comprise an open compartment into which the detergent composition is added. The second water-soluble film according to the present invention is then laid over the first film in such an orientation as to close the opening of the compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the detergent composition according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least two internal compartments, wherein the liquid laundry detergent composition is comprised in at least one of the compartments, preferably wherein the unit dose article comprises at least three compartments, wherein the detergent composition is comprised in at least one of the compartments.

First Water-Soluble Film and Second Water-Soluble Film

The water-soluble unit dose article comprises a first water-soluble film and a second water-soluble film and the first water-soluble film and the second water-soluble film are chemically different to one another.

For the avoidance of doubt, in the context of the present invention 'chemically different' herein means where the 'virgin films', i.e. films received from the supplier/manufacture and prior to unwinding on a unit dose article making unit, having at least one substance present in at least one of the film compositions that differentiates the first from the second film composition and impacts at least the water capacity, per the test method described herein, rendering this at least one physical film property different between the first and second films. Varying chemical compositions of films due to natural making processes i.e. batch to batch variations are as such not considered chemically different films within the scope of this invention.

Non limiting examples of chemically differentiating substances include use of different polymer target resins and or content, different plasticizer composition and or content or different surfactant and or content. Water soluble unit dose articles comprising films solely differing in physical properties but having the same substance content such as films solely differing in film thickness are considered outside the scope of this invention. Unit dose articles made from films being solely differentiated through the presence versus the absence of a coating layer are also considered outside the scope of the invention.

The first water-soluble film has a first water capacity, and the second water-soluble film has a second water capacity wherein the first water capacity is less than the second water capacity.

The difference between the water capacity of the first water soluble film and the second water-soluble film is between 0.01% and 1%, preferably from 0.03% to 0.5%, most preferably from 0.05% to 0.3%. The first water-soluble film and the second water-soluble film are described in more detail below. By 'difference' we herein mean the difference in the value of the first water capacity and the value of the second water capacity. By 'water capacity' we herein mean the capacity of the film to absorb water over a fixed period of time at a particular relative humidity and temperature, measured as a mass increase of the film being tested. The method for measuring water capacity is described in more detail below.

Preferably, the first water-soluble film has a water capacity from 1% to 10%, more preferably from 2% to 8%, most preferably from 3% to 6%.

Preferably, the second water-soluble film has a water capacity from 1.5% to 12%, preferably from 2.5% to 10%, more preferably from 3.5% to 8%.

Preferably, the first water-soluble film is thermoformed during manufacture of the unit dose article. By 'thermoforming' we herein mean that the film is heated prior to deformation, i.e. by passing the film under an infrared lamp, the deformation step preferably being enabled by laying the water soluble film over a cavity and applying vacuum or an under pressure inside the cavity under the film. The second water-soluble film may be thermoformed during manufacture of the unit dose article. Alternatively the second water-soluble film may not be thermoformed during manufacture of the unit dose article. Preferably, the first water-soluble film is thermoformed during manufacture of the unit dose article and the second water-soluble film is not thermoformed during manufacture of the unit dose article.

The first water-soluble film, the second water-soluble film or a mixture thereof independently may have a thickness before incorporation into the unit dose article of between 40 microns and 100 microns, preferably between 60 microns and 90 microns, more preferably between 70 microns and 80 microns.

Preferably the difference in thickness before incorporation into the unit dose article between the first water-soluble film and the second water-soluble film is less than 50%, preferably less than 30%, more preferably less than 20%, even more preferably less than 10%, or the thicknesses may be equal.

The first water-soluble film and the second water-soluble film according to the invention are preferably single layer films, more preferably manufactured via solution casting.

The first water-soluble film may have a first tensile strain at break of between 300% and 1600%, preferably between 400% and 1200%, more preferably between 700% and 1200%. By tensile strain at break we herein mean the ability of the film, pre-equilibrated with the detergent composition contacting the film in a unit dose article comprising said film and detergent composition, to elongate prior to breaking when a stress is applied. The method to determine tensile strain at break is described in more detail below.

The second water-soluble film may have a second tensile strain at break of between 300% and 1200%, preferably between 500% and 1000%. The method to determine tensile strain at break is described in more detail below.

The difference between the first tensile strain at break and the second tensile strain at break may be from 10% to 1000%, preferably from 100% to 750%, more preferably from 200% to 500%. By 'difference in tensile strain at break' we herein mean the difference in the value of the first tensile strain at break and the second tensile strain at break.

Preferably, the first water soluble film has a first elongation modulus, the second water soluble film has a second elongation modulus, the first elongation modulus is greater than the second elongation modulus, and the difference between the first elongation modulus and the second elongation modulus is from a 0.5 MPa to 10 MPa, preferably from 1 MPa to 8 MPa, more preferably from 2 MPa to 7 MPa.

By 'difference' we herein mean the difference in the value of the first elongation modulus and the value of the second elongation modulus. By 'elongation modulus' we herein mean the ability of the film to be elongated when a stress is applied. The method for measuring elongation modulus is described in more detail below.

Preferably, the first elongation modulus is from 1 MPa to 20 MPa, more preferably from 3 MPa to 20 MPa.

Preferably, the second elongation modulus is from 1 MPa to 15 MPa, more preferably from 3 MPa to 15 MPa.

Preferably, the first water soluble film comprises a first water soluble resin and the second water soluble film comprises a second water soluble resin. Preferably, the first water soluble resin comprises at least one polyvinyl alcohol homopolymer or at least one polyvinylalcohol copolymer or a blend thereof and the second water soluble resin comprises at least one polyvinyl alcohol homopolymer or at least one polyvinylalcohol copolymer or a blend thereof.

The first water soluble resin may comprise a blend of a polyvinyl alcohol homopolymer and a polyvinyl alcohol copolymer comprising an anionic monomer unit, preferably wherein the blend comprises from 0% to 70% by weight of the first water soluble resin of the polyvinyl alcohol copolymer comprising an anionic monomer unit and from 30% to about 100% by weight of the first water soluble resin of the polyvinyl alcohol homopolymer, more preferably wherein the blend comprises from 10% to 70%, even more preferably from 15% to less than 65%, even more preferably from 20% to 50%, most preferably from 30% to 40% of the polyvinyl alcohol copolymer comprising an anionic monomer unit and from about 30% to about 90%, or greater than 35% to about 85%, or from about 50% to about 80%, or from about 60 wt % to about 70 wt % by weight of the first water soluble resin of the polyvinyl alcohol homopolymer, based on the total weight of the first water soluble resin. The polyvinyl alcohol copolymer can be present at a concentration which, together with the concentration of the polyvinyl alcohol homopolymer, sums to 100%.

Polyvinyl alcohol homopolymer means polyvinyl alcohol comprising polyvinyl alcohol units and optionally but preferably polyvinylacetate units. Polyvinyl alcohol copolymer means a polymer comprising polyvinyl alcohol units, optionally but preferably polyvinyl acetate units and anionically modified polyvinylalcohol units.

The second water soluble resin may comprise a blend of a polyvinyl alcohol homopolymer and a polyvinyl alcohol copolymer comprising an anionic monomer unit, preferably wherein the blend comprises from 0% to 70% of the polyvinyl alcohol copolymer comprising an anionic monomer unit and from 30% to 100% of the polyvinyl alcohol homopolymer, based on the total weight of the second water soluble resin in the film, more preferably wherein the blend comprises from 10% to 70%, even more preferably from 15% to 65%, even more preferably from 20% to 50%, most preferably from 30% to 40% of the polyvinyl alcohol copolymer comprising an anionic monomer unit and from 30% to 90%, or from 35% to 85%, or from 50% to 80%, or from 60 wt % to 70 wt % by weight of the second water soluble resin of the polyvinyl alcohol homopolymer, based on the total weight of the second water soluble resin in the film. The polyvinyl alcohol copolymer can be present at a concentration which, together with the concentration of the polyvinyl alcohol homopolymer, sums to 100%.

The anionic monomer unit present in the polyvinyl alcohol copolymer of the first resin, present in the polyvinyl alcohol copolymer of the second resin, or a mixture thereof may independently be selected from the group consisting of anionic monomers derived from of vinyl acetic acid, alkyl acrylates, maleic acid, monoalkyl maleate, dialkyl maleate, monomethyl maleate, dimethyl maleate, maleic anhydride, fumaric acid, monoalkyl fumarate, dialkyl fumarate, monomethyl fumarate, dimethyl fumarate, fumaric anhydride, itaconic acid, monomethyl itaconate, dimethyl itaconate, itaconic anhydride, citraconic acid, monoalkyl citraconate, dialkyl citraconate, citraconic anhydride, mesaconic acid, monoalkyl mesaconate, dialkyl mesaconate, mesaconic anhydride, glutaconic acid, monoalkyl glutaconate, dialkyl glutaconate, glutaconic anhydride, vinyl sulfonic acid, alkyl sulfonic acid, ethylene sulfonic acid, 2-acrylamido-1-methyl propane sulfonic acid, 2-acrylamide-2-methylpropanesulfonic acid, 2-methylacrylamido-2-methylpropanesulfonic acid, 2-sulfoethyl acrylate, alkali metal salts thereof, esters thereof, and combinations thereof;

preferably, wherein the anionic monomer unit is selected from the group consisting of anionic monomers derived from maleic acid, monoalkyl maleate, dialkyl maleate, maleic anhydride, alkali metal salts thereof, esters thereof, and combinations thereof;

more preferably wherein the anionic monomer unit is selected from the group consisting of anionic monomers derived from maleic acid, monomethyl maleate, dimethyl maleate, maleic anhydride, alkali metal salts thereof, esters thereof, and combinations thereof.

Preferably, the first and second polyvinyl alcohol copolymers independently comprise from 1 mol % to 8 mol % more preferably from 2 mol % to 5 mol %, most preferably from 3 mol % to 4 mol % of the anionic monomer unit with respect to total polyvinyl alcohol copolymer present.

Preferably, the first polyvinyl alcohol homopolymer and second polyvinyl alcohol homopolymer and the first polyvinyl alcohol copolymer and second polyvinyl alcohol copolymer independently have a degree of hydrolysis of from 80% to 99% preferably from 85% to 95% more preferably from 86% and 93%.

Preferably, the first polyvinyl alcohol homopolymers and second polyvinyl alcohol homopolymer and first polyvinyl alcohol copolymer and second polyvinyl alcohol copolymer independently have a 4% solution viscosity in demineralized water at 25° C. in a range of 4 cP to 40 cP, preferably of 10 cP to 30 cP, more preferably of 12 cP to 25 cP.

Preferably, the first water-soluble film and the second water-soluble film independently have a water soluble resin content of between 30% and 90%, more preferably between 40% and 80%, even more preferably between 50% and 75%, most preferably between 60% and 70% by weight of the film.

Preferably, the water-soluble unit dose article exhibits a dissolution profile, according to the unit dose article dose article machine wash dissolution test method described below of less than 6.2 preferably less than 6 more preferably less than 5.8.

The first and or second film may independently be opaque, transparent or translucent. The first and or second film may independently comprise a printed area. The printed area may cover between 10 and 80% of the surface of the film; or between 10 and 80% of the surface of the film that is in contact with the internal space of the compartment; or between 10 and 80% of the surface of the film and between 10 and 80% of the surface of the compartment.

The area of print may cover an uninterrupted portion of the film or it may cover parts thereof, i.e. comprise smaller areas of print, the sum of which represents between 10 and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The first and or second film may independently comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 ppm.

The first and or second film may also comprise other actives typically known by a skilled person in the art including water, plasticizer and surfactant.

Detergent Composition

The detergent composition may be in the form of free flowing powder, a liquid, a compacted solid, a gel or a mixture thereof.

The detergent composition may be in the form of a free flowing powder. Such a free flowing powder may have an average particle size diameter of between 100 microns and 1500 microns, preferably between 100 microns and 1000 microns, more preferably between 100 microns and 750 microns. Those skilled in the art will be aware of standard techniques to measure particle size. The detergent composition may be a free flowing laundry detergent composition.

The detergent composition may be a liquid. In relation to the liquid detergent composition of the present invention, the term 'liquid' encompasses forms such as dispersions, gels, pastes and the like. The liquid composition may also include gases in suitably subdivided form. However, the liquid composition excludes forms which are non-liquid overall, such as tablets or granules.

The detergent composition may be a liquid laundry detergent composition. The term 'liquid laundry detergent composition' refers to any laundry detergent composition comprising a liquid capable of wetting and treating fabric e.g., cleaning clothing in a domestic washing machine.

The laundry detergent composition is used during the main wash process but may also be used as pre-treatment or soaking compositions.

Laundry detergent compositions include fabric detergents, fabric softeners, 2-in-1 detergent and softening, pre-treatment compositions and the like.

The laundry detergent composition may comprise an ingredient selected from bleach, bleach catalyst, dye, hueing dye, brightener, cleaning polymers including alkoxylated polyamines and polyethyleneimines, soil release polymer, surfactant, solvent, dye transfer inhibitors, chelant, builder, enzyme, perfume, encapsulated perfume, polycarboxylates, rheology modifiers, structurant, hydrotropes, pigments and dyes, opacifiers, preservatives, anti-oxidants, processing aids, conditioning polymers including cationic polymers, antibacterial agents, pH trimming agents such as hydroxides and alkanolamines, suds suppressors, and mixtures thereof.

Surfactants can be selected from anionic, cationic, zwitterionic, non-ionic, amphoteric or mixtures thereof. Preferably, the fabric care composition comprises anionic, non-ionic or mixtures thereof.

The anionic surfactant may be selected from linear alkyl benzene sulfonate, alkyl ethoxylate sulphate and combinations thereof.

Suitable anionic surfactants useful herein can comprise any of the conventional anionic surfactant types typically used in liquid detergent products. These include the alkyl benzene sulfonic acids and their salts as well as alkoxylated or non-alkoxylated alkyl sulfate materials.

The non-ionic surfactant may be selected from fatty alcohol alkoxylate, an oxo-synthesised fatty alcohol alkoxylate, Guerbet alcohol alkoxylates, alkyl phenol alcohol alkoxylates or a mixture thereof. Suitable nonionic surfactants for use herein include the alcohol alkoxylate nonionic surfactants. Alcohol alkoxylates are materials which correspond to the general formula: $R^1(C_mH_{2m}O)_nOH$ wherein IV is a $C_8$-$C_{16}$ alkyl group, m is from 2 to 4, and n ranges from about 2 to 12. In one aspect, $R^1$ is an alkyl group, which may be primary or secondary, that comprises from about 9 to 15 carbon atoms, or from about 10 to 14 carbon atoms. In one aspect, the alkoxylated fatty alcohols will also be ethoxylated materials that contain on average from about 2 to 12 ethylene oxide moieties per molecule, or from about 3 to 10 ethylene oxide moieties per molecule.

The shading dyes employed in the present laundry detergent compositions may comprise polymeric or non-polymeric dyes, pigments, or mixtures thereof. Preferably the shading dye comprises a polymeric dye, comprising a chromophore constituent and a polymeric constituent. The chromophore constituent is characterized in that it absorbs light in the wavelength range of blue, red, violet, purple, or combinations thereof upon exposure to light. In one aspect, the chromophore constituent exhibits an absorbance spectrum maximum from about 520 nanometers to about 640 nanometers in water and/or methanol, and in another aspect, from about 560 nanometers to about 610 nanometers in water and/or methanol.

Although any suitable chromophore may be used, the dye chromophore is preferably selected from benzodifuranes, methine, triphenylmethanes, napthalimides, pyrazole, napthoquinone, anthraquinone, azo, oxazine, azine, xanthene, triphenodioxazine and phthalocyanine dye chromophores. Mono and di-azo dye chromophores are preferred.

The dye may be introduced into the detergent composition in the form of the unpurified mixture that is the direct result of an organic synthesis route. In addition to the dye polymer therefore, there may also be present minor amounts of un-reacted starting materials, products of side reactions and mixtures of the dye polymers comprising different chain lengths of the repeating units, as would be expected to result from any polymerisation step.

The laundry detergent compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, lignin-ases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

The laundry detergent compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof.

The composition may comprise a brightener. Suitable brighteners are stilbenes, such as brightener 15. Other suitable brighteners are hydrophobic brighteners, and brightener 49. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form.

The compositions herein may also optionally contain one or more copper, iron and/or manganese chelating agents. The chelant may comprise 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

The laundry detergent composition may comprise one or more polymers. Suitable polymers include carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof.

Other suitable cellulosic polymers may have a degree of substitution (DS) of from 0.01 to 0.99 and a degree of blockiness (DB) such that either DS+DB is of at least 1.00 or $DB+2DS-DS^2$ is at least 1.20. The substituted cellulosic polymer can have a degree of substitution (DS) of at least 0.55. The substituted cellulosic polymer can have a degree of blockiness (DB) of at least 0.35. The substituted cellulosic polymer can have a DS+DB, of from 1.05 to 2.00. A suitable substituted cellulosic polymer is carboxymethylcellulose.

Another suitable cellulosic polymer is cationically modified hydroxyethyl cellulose.

Suitable perfumes include perfume microcapsules, polymer assisted perfume delivery systems including Schiff base perfume/polymer complexes, starch-encapsulated perfume accords, perfume-loaded zeolites, blooming perfume accords, and any combination thereof. A suitable perfume microcapsule is melamine formaldehyde based, typically comprising perfume that is encapsulated by a shell comprising melamine formaldehyde. It may be highly suitable for such perfume microcapsules to comprise cationic and/or cationic precursor material in the shell, such as polyvinyl formamide (PVF) and/or cationically modified hydroxyethyl cellulose (catHEC).

Suitable suds suppressors include silicone and/or fatty acid such as stearic acid.

The laundry detergent composition maybe coloured. The colour of the liquid laundry detergent composition may be the same or different to any printed area on the film of the article. Each compartment of the unit dose article may have a different colour. Preferably, the liquid laundry detergent composition comprises a non-substantive dye having an average degree of alkoxylation of at least 16.

At least one compartment of the unit dose article may comprise a solid. If present, the solid may be present at a concentration of at least 5% by weight of the unit dose article.

Process of Making

Those skilled in the art will be aware of processes to make the detergent composition of the present invention. Those skilled in the art will be aware of standard processes and equipment to make the detergent compositions.

Those skilled in the art will be aware of standard techniques to make the unit dose article. Standard forming processes including but not limited to thermoforming and vacuum forming techniques may be used.

A preferred method of making the water-soluble unit dose article according to the present invention comprises the steps of moulding a first water-soluble film in a mould to form an open cavity, filling the cavity with the detergent composition, laying a second film over the first film to close the cavity, and sealing the first and second films together preferably through solvent sealing, the solvent preferably comprising water, to produce the water-soluble unit dose article.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Test Protocols

1. Unit Dose Article Machine Wash Dissolution Test Method

This method is designed to assess the relative dissolution properties of laundry water soluble unit dose articles under stressed washing machine conditions. For this method Electrolux Programmable Washing machines type W565H, an adjusted EMPA221 load (EMPA221 source: Swissatest—SWISSatest testsmaterials, Movenstrasse 12 CH9015 St Gallen, Switzerland) and Digieye picture taking equipment (Digieye by VeriVide) were used.

The adjusted EMPA221 load was prepared by coloring the load into orange by using commercially available dying solutions for in washing machines dying (Dylon goldfish orange washing machine dye (No 55)). To color the load any standard household washing machine can be used, employing a standard cotton cycle at 40° C. 500 g of salt and 200 g of the Dylon goldfish orange machine dye are added to the drum of the washing machine. The drum was consequently moved to the left and the right until the salt and the dye were not visible anymore. 25 EMPA 221 items (size of 50 cm×50 cm, overlocked on the edges to prevent fraying), were consequently evenly distributed over the drum without folding of the items. A standard cotton cycle at 40° C. was run at a water hardness of 15 gpg. After completion of the cycle 50 g of Ariel Sensitive powder was added into the dispenser and a normal cotton cycle at 40° C. was run at a water hardness of 15 gpg. After completion of this cycle 2 additional normal cotton cycles at 40° C. without any detergent were run at a water hardness of 15 gpg, followed by line-drying the items. To note: Brand new EMPA221 items must be desized before coloring them by adding 25 items into a front loading Miele washing machine and running 2 short cotton cycles at 60° C. (approximate duration of 1 h30) with 50 g of Ariel sensitive powder and a water hardness of 15 gpg, followed by running 2 more short cotton cycles at 60° C. (approximate duration of 1 h30) with no detergent and a water hardness of 15 gpg, followed by tumble drying.

The Electrolux W565 programmable washing machines were programmed with 2 programs. The first program was designed to equally wet the load (pre-wet program). The second program (dissolution program) was utilized to simulate 10 min of a Western Europe stressed cycle setting, followed by pumping out the water and starting a spin of 3 min at 1100 rpm.

| | | Pre-wet program | Dissolution program |
|---|---|---|---|
| Wash | Time | 5 min | 10 min |
| | Motor rotation | 49 rpm | 40 rpm |
| | Water intake | 12 L | 4 L |
| | Heating | No heating | No heating |
| | Motor action time clockwise | 28 s | 28 s |
| | Motor resting time | 12 s | 12 s |
| | Motor action time Counterclockwise | 28 s | 28 s |
| Drain | Draining time | 20 s | 20 s |
| | Motor rotation | 20 rpm | 49 rpm |
| Extraction | Time | NA | 3 min |
| | Motor rotation | NA | 1100 rpm |

A load consisting of 50 dyed EMPA221 fabrics (ca. 2.45 kg) was evenly introduced in the Electrolux W565 washing machine and the pre-wet program was started. After the pre-wet program, 6 water soluble unit dose articles were distributed evenly across the wet load, after which the dissolution program was initiated. At the end of the full program, the wet load was transferred to a grading room (equipped with D65 lighting conditions) to be assessed for residues by expert graders. Each fabric which had discoloration spots due to remnant detergent or excess PVA, was selected out of the load for image analysis.

This image analysis was conducted by acquiring pictures of each side of the selected fabrics using the Digi-Eye camera (setting: "d90 Diffuse Light. Shutter time ¼. Aperture 8"). The fabrics should be put onto a gray or black background to enhance the contrast. After this the image was assessed through image analysis software to calculate the total size of residue detected in the load (pixel count). This tool detects residues by identifying spots that are of a different color than the normal ballast, using delta E thresholding (delta E of 6). For one machine and load a residue score is then calculated by summing the total area of residues present in the load. The logarithmic value of the total residue area is calculated and the average of 4 external replicates, i.e. 4 different washing machine runs, was reported.

2. Method for Measurement of Water Capacity

Water capacity was measured with a DVS (Dynamic Vapor Sorption) Instrument. The instrument used was a SPS-DVS (model SPSx-1μ-High load with permeability kit) from ProUmid. The DVS uses gravimetry for determination of moisture sorption/desorption and is fully automated.

The accuracy of the system is ±0.6% for the RH (relative humidity) over a range of 0-98% and ±0.3° C. at a temperature of 25° C. The temperature can range from +5 to +60° C. The microbalance in the instrument is capable of resolving 0.1 μg in mass change. 2 replicates of each film are measured and the average water capacity value is reported.

For the specific conditions of the test, a 6 pan carousel which allows to test 5 films simultaneously (1 pan is used as a reference for the microbalance and needs to remain empty) was used.

Each pan has an aluminum ring with screws, designed to fix the films. A piece of film was placed onto a pan and after gentle stretching, the ring was placed on top and the film was tightly fixed with the screws and excess film removed. The film covering the pan surface had an 80 mm diameter.

The temperature was fixed at 20° C. Relative humidity (RH) was set at 35% for 6 hours, and then gradually raised onto 50% in 5 min. The RH remained at 50% for 12 hours. The total duration of the measurement was 18 hours.

The cycle time (=time between measuring each pan) was set to 10 min and the DVS records each weight result vs. time and calculates automatically the % Dm (relative mass variation versus starting weight of the film, i.e. 10% reflects a 10% film weight increase versus starting film weight).

The water capacity (or % Dm gained over 50% RH cycle during the fixed time of 12 hours at 20° C.) was calculated by difference of the value % Dm at 50% RH (last value measured at 50% RH) minus % Dm at 35% RH (last value before going up to 50% RH).

3. Tensile Strain Test and e-Modulus Test

A water-soluble film characterized by or to be tested for tensile strain according to the Tensile Strain (TS) Test and e-modulus (elongation modulus or tensile stress) according to the Modulus (MOD) Test was analyzed as follows. The procedure includes the determination of tensile strain and the determination of e-modulus according to ASTM D 882 ("Standard Test Method for Tensile Properties of Thin Plastic Sheeting"). An INSTRON tensile testing apparatus (Model 5544 Tensile Tester or equivalent—Instron Industrial Products, 825 University Ave., Norwood, Mass. 02062-2643) was used for the collection of film data. A minimum of three test specimens, each cut with reliable cutting tools (e.g. JDC precision sample cutter, Model 1-10, from Thwing Albert Instrument Company, Philadelphia, Pa. U.S.A.) to ensure dimensional stability and reproducibility, were tested in the machine direction (MD) (where applicable), i.e. water soluble film roll winding/unwinding direction, for each measurement. Water soluble films were pre-conditioned to testing environmental conditions for a minimum of 48 h. Tests were conducted in the standard laboratory atmosphere of 23±2.0° C. and 35±5% relative humidity. For tensile strain or modulus determination, 1"-wide (2.54 cm) samples of a single film sheet having a thickness of 3.0±0.15 mil (or 76.2±3.8 μm) are prepared. For e-modulus testing virgin films were tested. For tensile strain testing test films were first pre-immersed in testing detergent according to the protocol described below. The sample was then transferred to the INSTRON tensile testing machine to proceed with testing. The tensile testing machine was prepared according to manufacturer instructions, equipped with a 500 N load cell, and calibrated. The correct grips and faces were fitted (INSTRON grips having model number 2702-032 faces, which are rubber coated and 25 mm wide, or equivalent). The samples were mounted into the tensile testing machine, elongated at a rate of 1N/min, and analyzed to determine the e-modulus (i.e., slope of the stress-strain curve in the elastic deformation region) and tensile strain at break (i.e., % elongation achieved at the film break, i.e. 100% reflects starting length, 200% reflects a film that has been lengthened 2 times at film break). The average of minimum three test specimens was calculated and reported.

Film Pre-Immersion Protocol

A film sample measuring 11 cm by 12 cm was prepared of both films intended to be used to form a sealed compartment enclosing a liquid household detergent composition. A total of 750 ml of the household liquid detergent composition intended to be enclosed within a sealed compartment comprising the test films, was required for each test film. The bottom of a clean inert glass recipient was covered with a thin layer of liquid and the film to be tested was spread on the liquid; air bubbles trapped under the film were gently pushed towards the sides. The remaining liquid was then gently poured on top of the film, in such a way that the film was fully immersed into the liquid. The film should remain free of wrinkles and no air bubbles should be in contact with the film. The film stayed in contact with the liquid and was stored under closed vessel conditions for 6 days at 35° C. and 1 night at 21° C. A separate glass recipient was used for each test film. The film was then removed from the storage vessel, and the excess liquid was removed from the film. A piece of paper was put on the film which was laid on top of a bench paper, and then the film was wiped dry thoroughly with dry paper. Films were consequently pre-conditioned to tensile strain environmental testing conditions as described above. When intending enclosing solid household detergent compositions, virgin films were used for tensile strain testing.

EXAMPLES

The following unit dose articles were prepared and tested for unit dose article dissolution per the protocol described herein. Comparative unit dose articles outside the scope of the invention were prepared using a single film type while example unit dose articles according to the invention were prepared from two chemically different films, differing in water capacity value according to the invention.

Multicompartment water soluble unit dose articles with a 41 mm×43 mm footprint, cavity depth of 20.1 mm and cavity volume of 25 ml, were made through thermo/vacuum forming. For dual film example unit dose articles films A and C were deformed under vacuum while films B and D were used as closing films respectively. A standard detergent composition, as commercially available in the UK in January 2016 in the bottom compartment of Fairy non-Bio 3-in-1 water soluble unit dose products was enclosed inside these unit dose articles.

Table 1 below details film compositions used to prepare comparative and example unit dose articles.

TABLE 1

| Starting film thickness = 76 micron | | | | | | | | | |
|---|---|---|---|---|---|---|---|---|---|
| | | Resin | | Polymer 1 (anionic-PVOH copolymer) | | | | Polymer 2 (PVOH homopolymer) | |
| | | content in film | Blend ratio | Anionic source | Anionic substition | dH | 4% viscosity | dH | 4% viscosity |
| Example 1 | | | | | | | | | |
| Comparative article 1 (single film type = A) | Film A | 65% | 40/60 | Monomethyl maleate (carboxylated) | 4% | 89% | 16 cps | 87% | 24 cps |
| Comparative article 2 (single film type = B) | Film B | 65% | 30/70 | Monomethyl maleate (carboxylated) | 4% | 89% | 16 cps | 87% | 13 cps |
| Example article 1 (dual film type = A + B) | Film A | 65% | 40/60 | Monomethyl maleate (carboxylated) | 4% | 89% | 16 cps | 87% | 24 cps |
| | Film B | 65% | 30/70 | Monomethyl maleate (carboxylated) | 4% | 89% | 16 cps | 87% | 13 cps |
| Example 2 | | | | | | | | | |
| Comparative article 3 (single film type = C) | Film C | 65% | 30/70 | Monomethyl maleate (carboxylated) | 4% | 89% | 16 cps | 88% | 17 cps |
| Comparative article 4 (single film type = D) | Film D | 65% | 30/70 | Monomethyl maleate (carboxylated) | 4% | 89% | 16 cps | 88% | 12 cps |
| Example article 2 (dual film type = C + D) | Film C | 65% | 30/70 | Monomethyl maleate (carboxylated) | 4% | 89% | 16 cps | 88% | 17 cps |
| | Film D | 65% | 30/70 | Monomethyl maleate (carboxylated) | 4% | 89% | 16 cps | 88% | 12 cps |

Table 2 below details key physical properties of the respective films used in the examples.

TABLE 2

| | Water capacity | e-modulus | Tensile strain at break |
|---|---|---|---|
| Film A | 5.058% | 11.4 MPa | 1123% |
| Film B | 5.141% | 8.25 MPa | 855% |
| Film C | 4.259% | 19.35 MPa | 906% |
| Film D | 4.406% | 14.29 MPa | 555% |

From Table 3 below it is clear that the wash process comprising the example unit dose articles 1 and 2 made of 2 films differing in water capacity according to the scope of the invention provides reduced fabric residues for the wash as compared to a wash process comprising the comparative examples 1, 2, 3 and 4 made out of a single type film.

| Article | Avg Log (residue area) |
|---|---|
| Example 1 | |
| Comparative article 1 | 6.4 |
| Comparative article 2 | 6.5 |
| article 1 | 5.7 |
| Example 2 | |

-continued

| Article | Avg Log (residue area) |
|---|---|
| Comparative article 3 | 6.3 |
| Comparative article 4 | 6.3 |
| article 2 | 5.7 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for washing fabrics comprising the steps of:

a. obtaining a water-soluble unit dose article comprising at least a first water-soluble film, a second water-soluble film and a detergent composition, wherein the first water-soluble film and the second water-soluble film are chemically different to one another, and wherein the first water-soluble film has a first water capacity, and wherein the second water-soluble film has a second water capacity, wherein the first water capacity is less than the second water capacity and wherein the difference between the water capacity of the first water soluble film and the second water-soluble film is between about 0.01% and about 1%;

b. adding the water-soluble unit dose article to an automatic washing machine with fabrics to be washed, wherein the fabrics comprise at least one stain or soil to be removed;

c. washing the fabrics in an automatic washing machine wash process wherein said process comprises a main wash step.

2. The process according to claim 1, wherein the first water-soluble film has a water capacity from about 1% to about 10%.

3. The process according to claim 1 wherein the second water-soluble film has a water capacity from about 1.5% to about 12%.

4. The process according to claim 1 wherein the difference in water capacity is from about 0.03% to about 0.5%.

5. The process according to claim 1, wherein said main wash step comprises the addition of between about 10 L and about 60 L water to the drum of the automatic washing machine.

6. The process according to claim 1 wherein the main wash step takes between about 5 minutes and about 90 minutes to complete.

7. The process according to claim 1 wherein the temperature of the water in the main wash step is between about 10° C. and about 45° C.

8. The process according to claim 1, wherein the automatic washing machine wash process comprises at least one rinse step.

9. The process according to claim 1 wherein the automatic washing machine wash process comprises a final rinse step, wherein the drum of the automatic washing machine rotates at a speed of between about 500 rpm and about 1700 rpm during the final rinse step.

10. The process according to claim 1 wherein the first water soluble film comprises a first water soluble resin and the second water soluble film comprises a second water soluble resin.

11. The process according to claim 1, wherein the first water soluble resin comprises a blend of a polyvinyl alcohol homopolymer and a polyvinyl alcohol copolymer comprising an anionic monomer unit, wherein the blend comprises from 0% to 70% by weight of the polyvinyl alcohol copolymer comprising an anionic monomer unit and from 30% to about 100% of the polyvinyl alcohol homopolymer, based on the total weight of the first water soluble resin in the first film.

12. The process according to claim 11, wherein the first water soluble resin comprises from about 10 wt % to about 70 wt % by weight of the first water soluble resin of the polyvinyl alcohol copolymer comprising an anionic monomer unit and from about 30% to about 90% by weight of the first water soluble resin of the polyvinyl alcohol homopolymer.

13. The process according to claim 11, wherein the first water soluble resin comprises from about 15 wt % to less than 65 wt % by weight of the first water soluble resin of the polyvinyl alcohol copolymer comprising an anionic monomer unit and greater than 35% to about 85% by weight of the first water soluble resin of the polyvinyl alcohol homopolymer.

14. The process according to claim 11, wherein the second water soluble resin comprises a blend of a polyvinyl alcohol homopolymer and a polyvinyl alcohol copolymer comprising an anionic monomer unit, wherein the blend comprises from 0% to 70% of the polyvinyl alcohol copolymer comprising an anionic monomer unit and from 30% to 100% of the polyvinyl alcohol homopolymer, based on the total weight of the second water soluble resin in the second film.

15. The process according to claim 11, wherein the second water soluble resin comprises from about 10 wt % to about 70 wt % by weight of the second water soluble resin of the polyvinyl alcohol copolymer comprising an anionic monomer unit and from about 30% to about 90% by weight of the second water soluble resin of the polyvinyl alcohol homopolymer.

16. The process according to claim 11, wherein the second water soluble resin comprises from about 15 wt % to about 65 wt % by weight of the second water soluble resin of the polyvinyl alcohol copolymer comprising an anionic monomer unit and from about 35% to about 85% by weight of the second water soluble resin of the polyvinyl alcohol homopolymer.

17. The process according to claim 11, wherein the anionic monomer unit is selected from the group consisting of anionic monomers derived from of vinyl acetic acid, alkyl acrylates, maleic acid, monoalkyl maleate, dialkyl maleate, monomethyl maleate, dimethyl maleate, maleic anhydride, fumaric acid, monoalkyl fumarate, dialkyl fumarate, monomethyl fumarate, dimethyl fumarate, fumaric anhydride, itaconic acid, monomethyl itaconate, dimethyl itaconate, itaconic anhydride, citraconic acid, monoalkyl citraconate, dialkyl citraconate, citraconic anhydride, mesaconic acid, monoalkyl mesaconate, dialkyl mesaconate, mesaconic anhydride, glutaconic acid, monoalkyl glutaconate, dialkyl glutaconate, glutaconic anhydride, vinyl sulfonic acid, alkyl sulfonic acid, ethylene sulfonic acid, 2-acrylamido-1-methyl propane sulfonic acid, 2-acrylamide-2-methylpropanesulfonic acid, 2-methylacrylamido-2-methylpropanesulfonic acid, 2-sulfoethyl acrylate, alkali metal salts thereof, esters thereof, and combinations thereof.

18. The process according to claim 1 wherein the first water-soluble film, is thermoformed during manufacture of the unit dose article, and wherein the second water-soluble film is not thermoformed during manufacture of the unit dose article.

19. The process according to claim 1 wherein the first water-soluble film, and the second water-soluble film independently have a thickness before incorporation into the unit dose article of between about 40 microns and about 100 micronsand wherein the difference in thickness before incorporation into the unit dose article between the first water-soluble film and the second water-soluble film is less than about 50%.

20. The process according to claim 1 wherein the first water-soluble film has a first tensile strain at break of between about 300% and about 1600%, and the second water-soluble film has a second tensile strain at break of between about 300% and about 1200%.

21. The process according to claim 20 wherein the difference between the first tensile strain at break and the second tensile strain at break is from about 10% to about 1000%.

* * * * *